US007847511B2

(12) United States Patent
Yoo et al.

(10) Patent No.: US 7,847,511 B2
(45) Date of Patent: Dec. 7, 2010

(54) CLEANER AND METHOD FOR DRIVING THE SAME

(75) Inventors: Myung Keun Yoo, Seoul (KR); Sang Young Kim, Gyeonggi-do (KR); Kwang Woon Ahn, Seoul (KR); Hyoun Jeong Shin, Incheon (KR)

(73) Assignee: LG Electronics Inc., Seoul (KR)

( * ) Notice: Subject to any disclaimer, the term of this patent is extended or adjusted under 35 U.S.C. 154(b) by 457 days.

(21) Appl. No.: 11/866,670

(22) Filed: Oct. 3, 2007

(65) Prior Publication Data

US 2008/0297101 A1 Dec. 4, 2008

(30) Foreign Application Priority Data

Jun. 1, 2007 (KR) ..... 10-2007-0053854

(51) Int. Cl.
*H02P 27/04* (2006.01)

(52) U.S. Cl. ..... 318/803; 318/254.1; 318/701; 318/722; 318/800

(58) Field of Classification Search ..... 318/254.1, 318/701, 700, 720, 722, 800, 801, 803
See application file for complete search history.

(56) References Cited

U.S. PATENT DOCUMENTS

| | | | | |
|---|---|---|---|---|
| 4,835,409 | A * | 5/1989 | Bhagwat et al. | 307/64 |
| 6,215,262 | B1 * | 4/2001 | Lim | 318/400.09 |
| 6,313,597 | B1 | 11/2001 | Elliott et al. | |
| 6,448,732 | B1 * | 9/2002 | Block | 318/635 |
| 7,049,786 | B1 * | 5/2006 | Toliyat et al. | 318/254.1 |
| 7,076,830 | B2 * | 7/2006 | Conner et al. | 15/339 |
| 7,439,702 | B2 * | 10/2008 | Smith et al. | 318/701 |
| 2004/0135537 | A1 | 7/2004 | Conner et al. | |
| 2005/0262660 | A1 | 12/2005 | Yoo et al. | |
| 2007/0159129 | A1 * | 7/2007 | Jadric et al. | 318/701 |

FOREIGN PATENT DOCUMENTS

| | | | |
|---|---|---|---|
| JP | 2006-095337 | A | 4/2006 |
| KR | 10-1998-0015028 | A | 5/1998 |
| KR | 10-2000-0011429 | A | 2/2000 |

OTHER PUBLICATIONS

U.S. Appl. No. 11/866,105, Yoo et al., filed Oct. 2, 2007.
U.S. Appl. No. 11/866,750, Kim et al, filed Oct. 3, 2007.
English language Abstract of KR 10-2000-0011429 A.
English language Abstract of JP 2006-095337 A.

* cited by examiner

*Primary Examiner*—Walter Benson
*Assistant Examiner*—Thai Dinh
(74) *Attorney, Agent, or Firm*—McKenna Long & Aldridge LLP

(57) ABSTRACT

A cleaner that can have the sufficient capability of collecting pollutant particles by a battery voltage as well as a AC voltage. The cleaner uses a switched reluctance motor to rotate a collecting fan. The switched reluctance motor is driven by a motor driver in one of a PWM mode or a pulse trigger mode. The motor driver drives the switched reluctance motor using one of the battery voltage and a DC voltage converted from the AC voltage, depending on whether the AC voltage is received. The PWM mode and the trigger mode are switched depending on whether the AC voltage is received. Accordingly, the cleaner makes it possible to reduce the time taken to clean up pollutant particles using the battery voltage to the time taken to clean up the pollutant particles using the AC voltage.

21 Claims, 3 Drawing Sheets

CLEANER AND METHOD FOR DRIVING THE SAME

FIELD OF THE INVENTION

The present disclosure relates to a power control system for controlling a voltage supplied to a motor. More particularly, the present disclosure relates to a power control system for controlling a voltage supplied to a motor for use in a vacuum cleaner.

BACKGROUND

The present disclosure relates to a cleaner for collecting pollutant particles such as dust and dirt and a method for driving the cleaner.

A cleaner makes it possible to clean a desired region without scattering pollutant particles such as dust and dirt. The reason for this is that the cleaner collects (or traps) pollutant particles by inhalation. In order to collect pollutant particles, the cleaner has a collecting fan that is rotated by an electric motor.

An AC voltage of about 110 V or 220 V is used to drive the electric motor of the cleaner. Thus, the cleaner is equipped with a power cord for receiving the AC voltage. This power cord, however, restricts a possible cleaning region that can be cleaned using the cleaner.

In order to overcome the restriction of the possible cleaning region, an AC/DC hybrid cleaner has been proposed that can collect pollutant particles by a DC voltage of a battery as well as by the AC voltage. The AC/DC hybrid cleaner drives an electric motor by the DC battery voltage in a region outside a radius of the length of a power cord, thereby making it possible to collect pollutant particles without the restriction of a possible clean region. While the AC/DC hybrid cleaner can obtain a DC voltage of about 310 V from the AC voltage, it can obtain a DC voltage of about 30 V from the battery. Such a difference of 10 times in the DC voltage leads to a difference of 100 times in motive power supplied to the collecting fan.

In order to minimize such a power difference caused by the DC voltage difference, the AC/DC hybrid cleaner has a hybrid universal motor with a dual-coil structure that enables a switch between a low-impedance mode and a high-impedance mode. When a 310 V DC voltage is supplied using the AC voltage, the hybrid universal motor is driven in a high-resistance mode where dual coils are connected in series to each other. On the other hand, when a DC voltage of about 30 V is supplied from the battery, the hybrid universal motor is driven in a low-resistance mode where the dual coils are connected in parallel to each other.

However, even by an impedance change due to a change in the connection structure of the dual lines, it is difficult to eliminate the difference between the power generated using the AC voltage and the power generated using the voltage of the battery. In actuality, the impedance characteristics of the dual coils of the hybrid universal motor is set to generate a rotational force (or a rotation speed) that is required in the high-resistance mode where the AC voltage is used. Therefore, in the low-resistance mode where the voltage of the battery is used, the hybrid universal motor generates only ¼ to ⅓ of the rotational force generated in the high-resistance mode where the AC voltage is used. Consequently, in the low-resistance mode where the voltage of the battery is used, the AC/DC hybrid cleaner including the hybrid universal motor has the poor capability of collecting pollutant particles and requires a long cleaning time.

Furthermore, the dual-coil structure increases the size of the hybrid universal motor by 50% or more. This increases the size of the AC/DC hybrid cleaner having the hybrid universal motor.

SUMMARY

Embodiments provide a cleaner that can have the sufficient capability of collecting pollutant particles by using a battery voltage as well as by using a AC voltage, and a method for driving the cleaner.

Embodiments also provide a cleaner that can reduce the time taken to clean up pollutant particles using a battery voltage to the time taken to clean up the pollutant particles using a AC voltage, and a method for driving the cleaner.

Embodiments also provide a cleaner with a reduced size and a method for driving the cleaner.

In one embodiment, a cleaner includes a switched reluctance motor for rotating a collecting fan; a battery; a voltage converter for converting a AC voltage received from a power source into a DC voltage; and a motor driver for driving the switched reluctance motor in one of a PWM mode and a pulse trigger mode by one of a voltage of the battery and the DC voltage, depending on whether the AC voltage is received.

In another embodiment, a cleaner drives, depending on whether a AC voltage is received from a power source, a switched reluctance motor in one of a PWM mode and a pulse trigger mode by using one of a voltage of a battery and the AC voltage.

In further another embodiment, a method for driving a cleaner includes: converting an AC voltage received from a power source into a DC voltage; actively switching the DC voltage and a voltage of a battery; detecting whether the AC voltage is received; and driving a switched reluctance motor in one of a PWM mode and a pulse trigger mode by using the actively-switched voltage, depending on the detection results.

The details of one or more embodiments are set forth in the accompanying drawings and the description below. Other features will be apparent from the description and drawings, and from the claims.

BRIEF DESCRIPTION OF THE DRAWINGS

The accompanying drawings are intended to provide a further understanding of the present disclosure. In the drawings.

DETAILED DESCRIPTION OF THE EMBODIMENTS

Reference will now be made in detail to the embodiments of the present disclosure, examples of which are illustrated in the accompanying drawings. Wherever possible, the same reference numbers will be used throughout the drawings to refer to the same or like parts.

Figure 1:
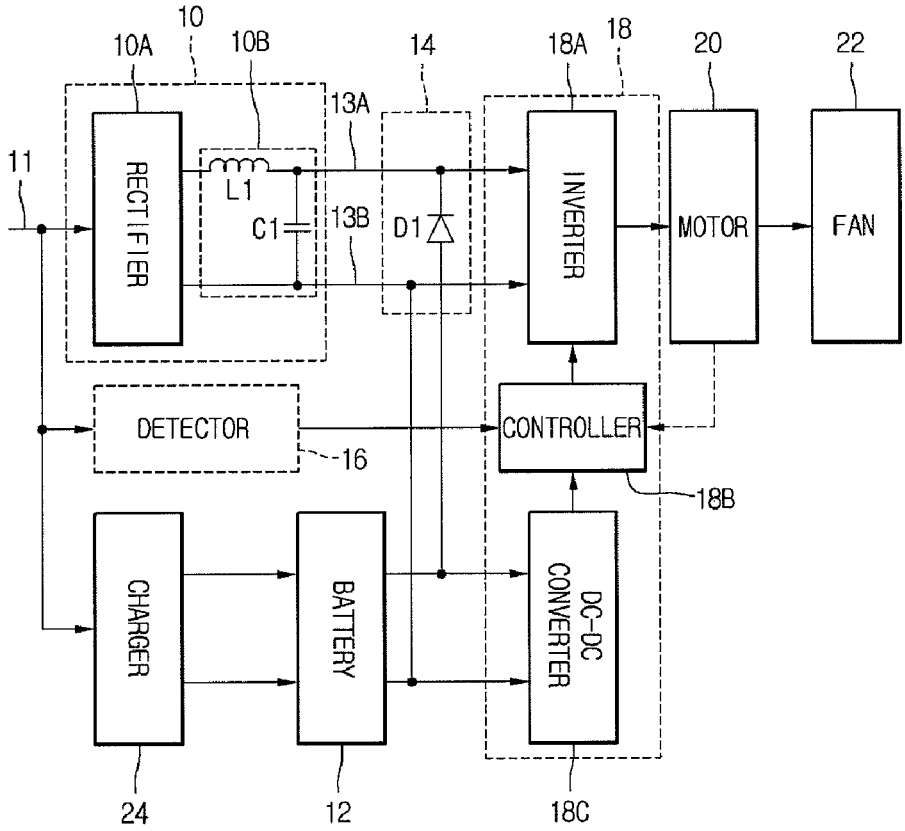
FIG. 1 is a block diagram of a cleaner according to an embodiment.

FIG. 1 is a block diagram of a cleaner according to an embodiment.

Referring to FIG. 1, the cleaner includes a battery 12 and an AC-DC converter 10 for converting an AC voltage into a DC voltage. The AC voltage is received from a conventional source, such as, for example, a power utility company, a power generator, or any other entity and/or device capable of generating an AC voltage.

The AC-DC converter 10 converts an AC voltage (e.g., 220 V), which is received from a power cord 11, into a DC voltage. When the AC voltage is provided through the power cord 11, an output DC voltage of the AC-DC converter 10 (hereinafter referred to as "first DC voltage") has a high voltage level of about 310 V. For this voltage conversion, the AC-DC converter 10 includes a smoother 10B and a rectifier 10A connected in series to the power cord 11. The rectifier 10A full-wave rectifies or half-wave rectifies the AC voltage received from the power cord 11, thereby outputting a ripple voltage. The smoother 10B smoothes the ripple voltage from the rectifier 10A to generate the first DC voltage. To this end, the smoother 10B includes a choke coil L1 connected between a high-voltage line 13A and a high-voltage output terminal of the rectifier 10A, and a capacitor C1 connected between the high-voltage line 13A and a base-voltage line 13B. The choke coil L1 suppresses a ripple component contained in the ripple voltage that will be provided from the high-voltage output terminal of the rectifier 10A to the high-voltage line 13A. The capacitor C1 is charged and discharged depending on the suppressed ripple voltage from the choke coil L1 such that the first DC voltage of about 310 V is applied on the high-voltage line 13A. The first DC voltage output from the smoother 10B is provided to an active voltage selector 14.

The battery 12 supplies its charged DC voltage to the active voltage selector 14. The charged DC voltage of the battery 12 (hereinafter referred to as "second DC voltage") has a low voltage level of about 28 to 50 V. In order to generate the second DC voltage with a low voltage level of about 28 to 50 V, the battery 12 includes about 24 to 30 charge cells. Ni-MH charge cells may be used as the charge cells of the battery 12.

The active voltage selector 14 monitors whether the first DC voltage is received from the AC-DC converter 10. Depending on whether the first DC voltage is received, the active voltage selector 14 provides one of the second DC voltage from the battery 12 and the first DC voltage from the AC-DC converter 10 to an inverter 18A of a motor driver 18. When the first DC voltage is not received from the AC-DC converter 10 (i.e., in a DC voltage mode), the active voltage selector 14 provides the second DC voltage from the battery 12 to the inverter 18A of the motor driver 18. On the other hand, when the first DC voltage is received from the AC-DC converter 10 (i.e., in an AC voltage mode), the active voltage selector 14 provides the first DC voltage to the inverter 18A of the motor driver 18. To this end, the active voltage selector 14 includes a unidirectional element (for example, diode D1) that is connected between a high-voltage output terminal of the battery 12 and the high-voltage line 13A (specifically, a connection node between the choke coil L1 and a high-voltage input terminal of the inverter 18A). When a voltage on the high-voltage line 13A is higher than a voltage on the high-voltage output terminal of the battery 12 (i.e., in the AC voltage mode where the first DC voltage is provided to the high-voltage line 13A), the diode D1 is turned off to interrupt the second DC voltage to be provided from the battery 12 to the inverter 18A. At this point, the first DC voltage is provided from the AC-DC converter 10 to the inverter 18A. On the other hand, when a voltage on the high-voltage line 13A is lower than a voltage on the high-voltage output terminal of the battery 12 (i.e., in the DC voltage mode where the first DC voltage is not provided to the high-voltage line 13A), the diode D1 is turned on to provide the second DC voltage from the battery 12 to the inverter 18A. The active voltage selector 14 may further include an additional diode that is connected between the choke coil L1 and the high-voltage line 13A (specifically, a connection node between the diode D1 and the high-voltage input terminal of the inverter 18A). The additional diode prevents the second DC voltage from the battery 12 from leaking to the AC-DC converter 10, thereby increasing the available time (i.e., the discharge period) of the battery 12.

The cleaner further includes a detector 16 connected to the power cord 11, and a serial circuit of a motor 20 and a collecting fan 22 connected the motor driver 18. The detector 16 detects whether the AC voltage is supplied through the power cord 11. Depending on the detection results, the detector 16 provides a controller 18B of the motor driver 18 with an AC voltage detection signal having one of a high logic voltage and a low logic voltage (i.e., a base voltage). When the AC voltage is supplied through the power cord 11, the detector 16 provides the controller 18B with an AC voltage detection signal with a high logic voltage for indicating or designating the AC voltage mode. On the other hand, when the AC voltage is not supplied through the power cord 11, the detector 16 provides the controller 18B with an AC voltage detection signal with a low logic voltage for indicating or designating the DC voltage mode. To this end, the detector 16 includes a diode for rectification and resistors for voltage division. Alternatively, the detector 16 may detect a voltage on an output terminal of the AC-DC converter 10 to determine whether the AC voltage is supplied. In this case, there may be an error in the determination by the detector 16 or the circuit configuration of the detector 16 may be complex.

Further alternatively, the detector 16 may be implemented using a program operating in the controller 18B. In this case, the controller 18 may be electromagnetically connected to the power cord 11.

Depending on the logic voltage levels of the AC voltage detection signal from the detector 16, the motor driver 18 drives the motor 20 in one of a pulse width modulation (PWM) mode and a pulse trigger mode. When the high logic voltage is received from the detector 16 (i.e., in the AC voltage mode), the motor driver 18 drives the motor 20 in a pulse trigger mode so that an average voltage provided to the motor 20 can be about 28 to 50 V that is identical to the second DC voltage from the battery 12. That is, when the AC voltage is supplied (i.e., in the AC voltage mode), the motor driver 18 drops the first DC voltage of about 310 V from the AC-DC converter 10 to about 28 to 50 V (i.e., the second DC voltage from the battery 12). In this case, the period of a trigger pulse applied to the motor 20 is minutely increased/decreased depending on the rotation period (or rotation speed) of the motor 20 while the width of the trigger pulse is maintained at a constant value independent of the rotation period of the motor 20, thereby adjusting the rotation speed (i.e., the rotational force) of the motor 20. On the other hand, when the low logic voltage is received from the detector 16 (i.e., in the DC voltage mode), the motor driver 18 drives the motor 20 in a PWM mode so that the second DC voltage from the battery 12 is used, as it is, to drive the motor 20. The rotation speed of the motor 20 may be adjusted according to the duty rate of a PWM component. When the duty rate of the PWM component increases, the rotation speed (i.e., the rotational force) of the motor 20 increases. To the contrary, when the duty rate of the PWM component decreases, the rotation speed (i.e., the rotational force) of the motor 20 decreases. In order to adjust the rotation speed (i.e., the rotation force) of the motor 20, the motor driver 18 may respond to key switches for output selection (not illustrated).

Figure 2:
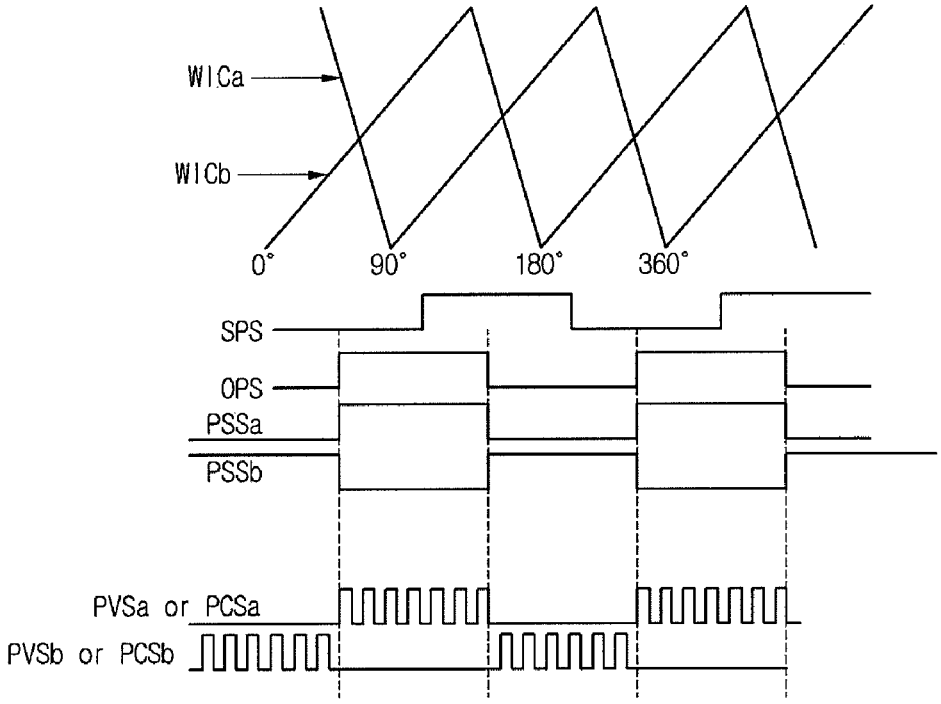
FIG. 2 is a waveform diagram of signals that are output from the respective parts of FIG. 1 in a DC drive mode.
Figure 3:
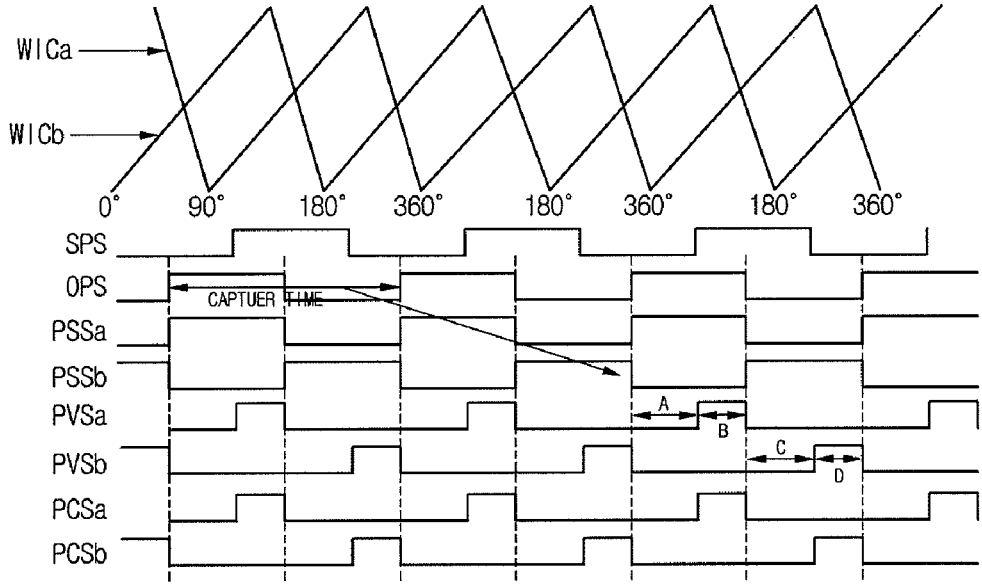
FIG. 3 is a waveform diagram of signals that are output from the respective parts of FIG. 1 in an AC drive mode.

In order to generate a phase voltage signal of PWM mode or pulse trigger mode to be provided to the motor, the motor driver 18 includes the controller 18B for controlling an inverting operation of the inverter 18A. Under the control of the controller 18B, the inverter 18A switches the selected DC voltage (i.e., the first or second DC voltage) from the active voltage selector 14 in a pulse trigger mode or a PWM mode to generate at least two phase voltage signals. In the DC voltage mode, the inverter 18A generates at least two phase voltage signals PVSa and PVSb that have a PWM component at every predetermined period (e.g., the rotation period of the motor 20) as illustrated in FIG. 2. The phase voltage signals PVSa and PVSb have a PWM component in rotation. The duty rate of the PWM component is adjusted according to the rotation speed (or the rotational force) of the motor 20, which is set by a user. In the AC voltage mode, the inverter 18A generates at least two phase voltage signals PVSa and PVSb that have a high trigger pulse at every predetermined period (e.g., the rotation period of the motor 20) as illustrated in FIG. 3. The high trigger pulses of the phase voltage signals PVSa and PVSb have a phase difference corresponding to "the number of 360°/phase voltage signals". The width of the trigger pulse is fixed independently of the rotation period (or the rotation speed) of the motor 20, while the period of the trigger pulse is minutely adjusted according to the rotation period (or the rotation speed) of the motor 20, so that the motor 20 rotates at the speed set by the user (or generates the rotational force set by the user).

In response to the AC voltage detection signal from the detector 16, the controller 18B provides the inverter 18A with at least two phase control signals PCSa and PCSb that have a PWM component in rotation as illustrated in FIG. 2 or have a trigger pulse at every predetermined period (e.g., the rotation period of the motor 20) as illustrated in FIG. 3. In the DC voltage mode where the AC voltage detection signal with a low logic voltage is generated by the detector 16, the phase control signals PCSa and PCSb generated by the controller 18B alternately have a PWM component for a predetermined period (i.e., a period corresponding to "the number of 360°/phase voltage signals") per the rotation period of the motor 20 as illustrated in FIG. 2. The duty rate of the PWM component is adjusted according to the desired rotation speed (or rotational force) of the motor 20. In the AC voltage mode where the AC voltage detection signal with a high logic voltage is generated by the detector 16, the phase control signals PCSa and PCSb from the controller 18B have a high trigger pulse per the rotation period of the motor 20 as illustrated in FIG. 3. The high trigger pulses contained in the phase control signals PCSa and PCSb have a phase difference corresponding to "the number of 360°/phase voltage signals". In addition, the width of the trigger pulse contained in each of the phase control signals PCSa and PCSb may be fixed independently of the desired rotation speed (or rotational force) of the motor 20, while the period of the trigger pulse in each of the phase control signals may be minutely adjusted according to the desired rotation speed (or rotational force) of the motor 20. According to an increase or decrease in the rotation period of the motor 20, the trigger pulse with the fixed width and the minutely adjusted period changes the average level of the voltage supplied to the motor 20, thereby increasing or decreasing the rotational force of the motor 20. In order to generate the phase control signals PCSa and PCSb, the controller 18B responds to at least two phase sensing signals PSSa and PSSb from the motor 20. For example, the controller 18B generates the first phase control signal PCSa in response to the first phase sensing signal PSSa and also generates the second phase control signal PCSb in response to the second phase sensing signal PSSb. In the AC voltage mode, as illustrated in FIG. 3, the controller 18B controls a falling edge of the first phase control signal PCSa to coincide with a falling edge of the first phase sensing signal PSSa and also controls a falling edge of the second phase control signal PCSb to coincide with a falling edge of the second phase sensing signal PSSb. In the DC voltage mode, as illustrated in FIG. 2, the controller 18B controls the first phase control signal PCSa to contain a PWM component for a high-voltage period of the first phase sensing signal PSSa and also controls the second phase control signal PCSb to contain a PWM component for a high-voltage period of the second phase sensing signal PSSb.

As illustrated in FIGS. 2 and 3, the controller 18B may respond to a start sensing signal STS and an operation sensing signal OPS as well as to the phase sensing signals PSSa and PSSb. On the basis of the start sensing signal STS, the controller 18B controls the trigger pulse period and the PWM component duty rate of the phase control signals PCSa and PCSb to have a great value until the motor 20 rotates at a desired rotation speed. When the rotation speed of the motor 20 reaches the desired rotation speed, the controller 18B control the trigger pulse period and the PWM component duty rate of the phase control signals PCSa and PCS, which will be provided to the inverter 18A, to have a value corresponding to the desired rotation speed. On the basis of the period of the operation sensing signal OPS, the controller 18B controls the trigger pulse period to have a value corresponding to the desired rotation speed. The phase of the operation sensing signal OPS is earlier by 30° to 50° than the phase of the start sensing signal STS. The phase difference between the operation sensing signal OPS and the start sensing signal STS is determined by the arrangement of a operation sensing sensor and a start sensing sensor included in the motor 20. For example, a central processing unit (CPU) or a microcomputer may be used as the controller 18B.

The motor driver 18 further includes a DC-DC converter 18C that is connected between the battery 12 and the controller 18B. The DC-DC converter 18C down-converts (level-shifts) the second DC voltage of the battery 12 to a transistor logic voltage (e.g., the first DC voltage of about 5 V). The transistor logic voltage generated by the DC-DC converter 18C is provided to the controller 18B so that the controller 18B can operate stably. In order to generate the transistor logic voltage stably using the second DC voltage, the DC-DC converter 18C includes a switched-mode power supply (SMPS). Alternatively, the DC-DC converter 18C may include a resistor-based voltage divider.

The motor 20 is driven by the phase voltage signals PVSa and PVSb from the inverter 18A of the motor driver 18 to generate rotational force (i.e., rotational torque) that will be transmitted to the collecting fan 22. A switched reluctance motor of at least two phases is used as the motor 20. The switched reluctance motor 20 generates the at least two phase sensing signals PSSa and PSSb. For example, two phase sensing signals PSSa and PSSb are generated by the switched reluctance motor 20. The switched reluctance motor 20 also generates the start sensing signal STS and the operation sensing signal OPS as well as the phase sensing signals. As illustrated in FIGS. 2 and 3, the phase of the start sensing signal STS is later by 30° to 50° than the phase of the first phase sensing signal PSSa and is earlier by 40° to 60° than the phase of the second phase sensing signal PSSb. The operation sensing signal OPS has the same phase and period as one of the phase sensing signals PSSa and PSSb. The operation sensing signal OPS generated by the switched reluctance motor 20 has the same phase and period as the first phase sensing signal PSSa, as illustrated in FIGS. 2 and 3. When the voltage of the battery 12 (i.e., the second DC voltage of 28 to 50 V) is used, the switched reluctance motor 20 has at least two coils with a characteristic impedance that is low enough to rotate the motor at a desired rotation speed (or to generate a desired rotational force). For example, a current with a waveform WICa/WICb illustrated in FIGS. 2 and 3 is excited in the first/second coil of the switched reluctance motor 20 by the first/second phase voltage signal PVSa and PVSb. Accordingly, the switched reluctance motor 20 is rotated at a desired rotation speed (e.g., 7000 to 9000 rpm) by PWM-mode phase voltage signals PVSa and PVSb as well as by trigger-pulse-mode phase voltage signals PVSa and PVSb with an average voltage of 28 to 50 V, thereby generating the rotational force with a desired strength. The use of the PWM-mode phase voltage signals can solve the problem of heat that is generated when the motor 20 rotates at a speed of 7000 to 9000 rpm in the AC voltage mode. In addition, the switched reluctance motor 20 with the low-characteristic-impedance coils is rotated at a desired speed by the phase voltage signal of a PWM component, thereby making it possible to generate a desired rotational force by the voltage of the battery 12 as well as by the AC voltage.

The collecting fan 22 is rotated by the rotational force (or rotational torque) of the motor 20 to generate inhalation force. This inhalation force (or suction force) causes pollutant particles (e.g., dust and dirt) to be collected into the collecting space (not illustrated) of the cleaner. The rotational force with a desired strength is supplied from the switched reluctance motor 20 with the low-characteristic-impedance coils by using the voltage of the battery 12 as well as by using the AC voltage. Accordingly, the collecting fan 22 can generate the inhalation force with a desired strength by using the voltage of the battery 12 as well as by using the AC voltage, thereby making it possible to reduce the time taken to clean up pollutant particles using the voltage of the battery 12 to about the time taken to clean up the pollutant particles using the AC voltage.

The cleaner further includes a charger 24 that is connected between the power cord 11 and the battery 12. In the AC voltage mode where the AC voltage is supplied through the power cord 11, the charger 24 performs a rectifying/smoothing operation to convert the AC voltage into the second DC voltage. In addition, the charger 16 supplies the second DC voltage to the battery 12 such that the battery 12 is charged with the second DC voltage.

Figure 4:
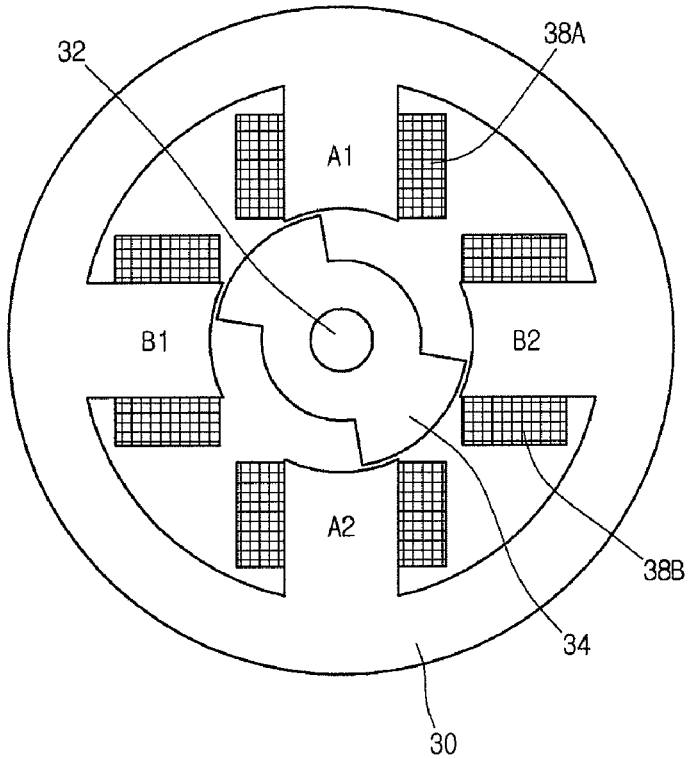
FIG. 4 is a sectional view of a motor illustrated in FIG. 1.
Figure 5:
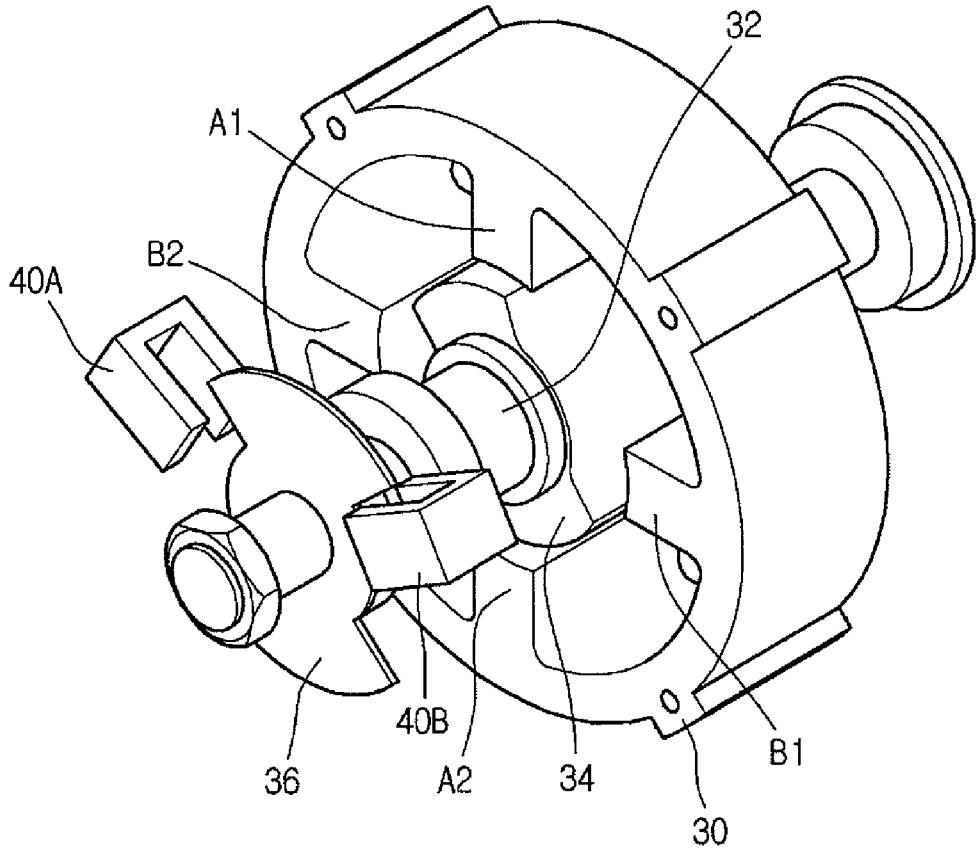
FIG. 5 is a perspective view of the motor illustrated in FIG. 1.

FIG. 4 is a sectional view of a two-phase switched reluctance motor 20, and FIG. 5 is a perspective view of the two-phase switched reluctance motor 20.

Referring to FIGS. 4 and 5, the two-phase switched reluctance motor 20 includes a stator 30 and a rotor shaft 32 disposed at a central axis of the stator 30. A rotor 34 is installed at a middle portion of the rotor shaft 32. The rotor 34 has salient poles. A shutter 36 is installed at one end of the rotor shaft 32, and the collecting fan 22 of FIG. 1 is installed at the other end of the rotor shaft 32.

The stator 30 has the shape of a cylinder. The stator 30 has first phase poles A1 and A2 and second phase poles B1 and B2 formed on its inner wall surface. The first phase poles A1 and A2 are arranged in such a way that they face each other with the rotor 34 therebetween. Likewise, the second phase poles B1 and B2 are arranged in such a way that they face each other with the rotor 34 therebetween. In addition, the first phase poles A1 and A2 and the second phase poles B1 and B2 are arranged in such a way that a line connecting the first phase poles A1 and A2 intersects with a line connecting the second phase poles B1 and B2.

A first phase coil 38A is wound around the first phase poles A1 and A2, and a second phase coil 38B is wound around the second phase poles B1 and B2. The first and second coils 38A and 38B are alternately excited by first and second phase voltage signals, which are alternately activated, to rotate the rotor shaft 32 including the rotor 34. The first and second coils 38A and 38B have a sufficiently-low characteristic impedance so that the rotor shaft 32 can be rotated by a desired force (i.e., torque) even when the first and second coils 38A and 38B are excited by phase voltage signals derived from the voltage of the battery 12.

In addition, the two-phase switched reluctance motor 20 further includes a first position detecting sensor 40A and a second position detecting sensor 40B. The first position detecting sensor 40A is located in the longitudinal direction of one of the first phase poles A1 and A2, and the second position detecting sensor 40B is located in the longitudinal direction of one of the second phase poles B1 and B2. The first and second position detecting sensor 40A and 40B respectively generate a first phase sensing signal and a second phase sensing signal by interaction with the shutter 36.

Furthermore, the two-phase switched reluctance motor 20 further includes an operation sensing sensor (not illustrated) and a start sensing sensor (not illustrated). The operation sensing sensor is disposed in line with one of the first and second position detecting sensors 40A and 40B. The start sensing sensor is disposed at an angle (e.g., 30° to 50° to the operation sensing sensor with respect to the rotor shaft 32. An operation sensing signal output from the operation sensing sensor has the same waveform as one of the first and second phase sensing signals. A start sensing signal output from the start sensing sensor has a 30° to 50° later phase than the operation sensing signal and has the same period as the operation sensing signal.

From the above structure of the two-phase switched reluctance motor, it can be understood by those skilled in the art that an at least three-phase switched reluctance motor includes at least three position detecting sensors, at least three coils, and at least three pairs of phase poles.

As described above, the cleaner according to the present disclosure uses the switched reluctance motor that has the sufficiently-low characteristic impedance to generate the desired rotational force by the voltage of the battery. Also, in the AC voltage mode where the AC voltage is supplied, the cleaner according to the present disclosure drops the DC voltage of about 310 V to about 28 to 50 V (i.e., the voltage of the battery) and supplies the same voltage to the switched reluctance motor. Accordingly, the switched reluctance motor can generate the desired rotational force by the voltage of the battery as well as by the AC voltage. Likewise, the collecting fan can generate the inhalation force with the desired strength by using the voltage of the battery as well as by using the AC voltage. Consequently, the cleaner according to the present disclosure can have the sufficiently-high capability of collecting pollutant particles and can reduce the time taken to clean up pollutant particles using the voltage of the battery 12 to about the time taken to clean up the pollutant particles using the AC voltage.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The present disclosure relates to subject matter contained in Korean Patent Application No. 10-2007-0053854, filed Jun. 1, 2007, the disclosure of which is expressly incorporated herein by reference, in its entirety.

What is claimed is:

1. A cleaner, comprising:

a motor configured to rotate a collecting fan;

a battery configured to output a first DC voltage;

a voltage converter configured to convert an AC voltage received from a power source into a second DC voltage; and a motor driver configured to provide one of the first and second DC voltage to the switched reluctance motor in one of two waveform modes according to whether or not the AC voltage is received, wherein the motor driver is further configured to apply the second DC voltage to the motor in the pulse trigger mode when the status of the AC voltage indicates the AC voltage is received, and to apply the first DC voltage to the motor in the PWM mode when the status of the AC voltage indicates the AC voltage is not received.

2. The cleaner according to claim 1, wherein at least one of the two waveform modes comprises a pulse width modulation (PWM) mode or a pulse trigger mode.

3. The cleaner according to claim 2, wherein the motor driver comprises:

an inverter configured to generate at least two phase voltage signals in one of the PWM mode and the pulse trigger mode, each of which is to be provided to the motor, using one of the first DC voltage and the second DC voltage; and a controller configured to control the waveform mode of the inverter based on the status of the AC voltage.

4. The cleaner according to claim 3, wherein the controller is further configured to control the inverter to adjust the phases of the at least two phase voltage signals on the basis of a rotation sensing signal received from the motor.

5. The cleaner according to claim 3, wherein the controller is further configured to control the inverter to generate a plurality of PWM-modulated phase voltage signals when the status of the AC voltage indicates the AC voltage is not received, and to control the inverter to generate a phase voltage signal of a trigger pulse according to a rotation period when the status of the AC voltage indicates the AC voltage is received.

6. The cleaner according to claim 3, further comprising:

a DC-DC converter configured to down-convert the first DC voltage to a down-converted voltage, and to provide the down-converted voltage to the controller.

7. The cleaner according to claim 1, wherein the motor comprises a switched reluctance motor.

8. The cleaner according to claim 1, further comprising:

a voltage selector configured to select one of the first DC voltage and the second DC voltage and to apply the selected DC voltage to the motor driver.

9. The cleaner according to claim 8, wherein the voltage selector comprises a unidirectional device configured to selectively interrupt the first DC voltage, which is to be supplied to the motor driver, based on whether the second DC voltage is being supplied to the motor driver.

10. The cleaner according to claim 1, further comprising a charger configured to charge the battery using the AC voltage from the power source.

11. The cleaner according to claim 1, further comprising a detector configured to detect the status of the AC voltage by determining whether the AC voltage is received on the basis of one of the AC voltage received from the power source and the second DC voltage, and to provide a detection result to the motor driver.

12. The cleaner according to claim 11, wherein the detector is further configured to be implemented using an operating program of the motor driver.

13. A method for driving a cleaner, comprising:

converting an AC voltage received from a power source into a first DC voltage;

switching between the first DC voltage and a second DC voltage received from a battery to provide a switched voltage;

detecting whether the AC voltage is received; and applying the switched DC voltage to a motor in one of two waveform modes based on the detection result, wherein the applying the switched DC voltage comprises:

providing the switched DC voltage to the motor in the pulse trigger mode when the AC voltage is received; and providing the switched DC voltage to the motor in the PWM mode when the AC voltage is not received.

14. The method according to claim 13, wherein at least one of the two waveform modes comprises a pulse width modulation (PWM) mode or a pulse trigger mode.

15. The method according to claim 13, wherein the motor comprises a switched reluctance motor.

16. The method according to claim 13, wherein the switching comprises:

monitoring the first DC voltage; and interrupting the second DC voltage based on a result of the monitoring.

17. The method according to claim 13, wherein the detecting whether the AC voltage is received comprises monitoring one of the AC voltage and the first DC voltage.

18. The method according to claim 13, wherein the detecting whether the AC voltage is received comprises detecting whether the AC voltage is received by monitoring a state of the AC voltage from the power source.

19. The method according to claim 13, further comprising charging the battery using the AC voltage.

20. A cleaner, comprising:

a motor configured to rotate a collecting fan;

a battery configured to output a first DC voltage;

a voltage converter configured to convert an AC voltage received from a power source into a second DC voltage;

a motor driver configured to provide one of the first and second DC voltage to the switched reluctance motor in one of two waveform modes according to whether or not the AC voltage is received; and a detector configured to detect the status of the AC voltage by determining whether the AC voltage is received on the basis of one of the AC voltage received from the power source and the second DC voltage, and to provide a detection result to the motor driver.

21. The cleaner according to claim 20, wherein the detector is further configured to be implemented using an operating program of the motor driver.

* * * * *